United States Patent [19]

Numata et al.

[11] 4,036,191

[45] July 19, 1977

[54] EXHAUST GAS RECIRCULATION SYSTEM

[75] Inventors: Kenichi Numata, Kariya; Yukihiko Muramatu, Hekinan, both of Japan

[73] Assignee: Nippondenso Co., Ltd., Kariya, Japan

[21] Appl. No.: 620,914

[22] Filed: Oct. 8, 1975

[30] Foreign Application Priority Data

Nov. 5, 1974 Japan ..... 49-134281[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,783,848 | 1/1974 | Ranft et al. | 123/119 A |
| 3,834,363 | 9/1974 | Goto et al. | 123/119 A |
| 3,834,366 | 9/1974 | Kingsbury | 123/119 A |
| 3,882,837 | 5/1975 | Horie et al. | 123/119 A |
| 3,885,540 | 5/1975 | Stadler | 123/119 A X |

*Primary Examiner*—Carroll B. Dority, Jr.
*Assistant Examiner*—Ira S. Lazarus
*Attorney, Agent, or Firm*—Cushman, Darby & Cushman

[57] ABSTRACT

In an exhaust gas recirculation system for internal combustion engines having a detachable gasket member between an exhaust gas recirculation valve and an exhaust pipe of the engine, the exhaust gas recirculation rate is controlled by a flow control orifice formed in the detachable gasket member, whereby the recirculation valve can be applied to various types of engines requiring various recirculation rates.

1 Claim, 1 Drawing Figure

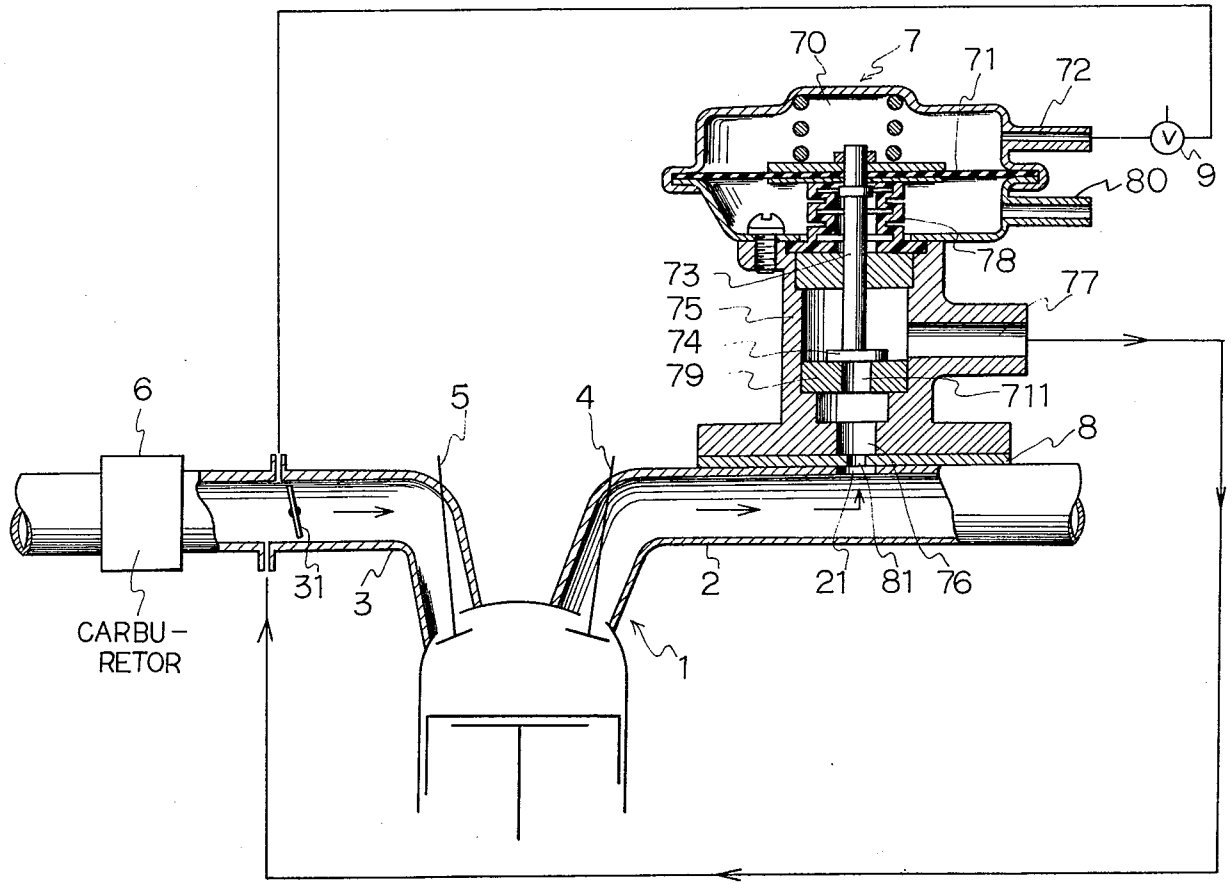
9
80
72
71
7
70
78
77
711
8
76
81
21
73
75
74
79
2
1
4
5
3
31
6
CARBU-
RETOR

EXHAUST GAS RECIRCULATION SYSTEM

BACKGROUND OF THE INVENTION

In a conventional exhaust gas recirculation system, as so many types of exhaust gas recirculation valves have been prepared to match the recirculation rate to various types of engine, the producing cost for each type of valve has inevitably increased. Each type of engine requires each rate of recirculation flow to match the amount of exhaust gas to the best performance of each engine and the requirement has been fulfilled by changing the dimension of the valve seat of the valve. Further in the conventional system, the cleaning of the valve seat with deposits, such as carbon has been troublesome, otherwise the valve might have miscontrolled the recirculation rate.

SUMMARY OF THE INVENTION

The object of the present invention is to provide an improved exhaust gas recirculation system for internal combustion engines which is applicable to many types of engine with low cost and can recover with ease the initial clean condition after the engine has run over the limited period.

Further object of the present invention is to provide a detachable gasket member between the recircuation valve and an exhaust pipe of the engine for controlling the recirculation rate by a flow control orifice formed therein The other objects of the present invention will become apparent from the following detailed desecription of the preferred embodiment of the present invention.

BRIEF DESCRIPTION OF THE DRAWING

The FIGURE shows a cross-sectional view of the essential part of the exhaust gas recirculation system of the present invention.

DETAILED DESCRIPTION OF THE PREFERRED EMBODIMENT

Referring to the FIGURE, the engine 1 has an exhaust pipe 2 and an intake pipe 3, which are valved by an exhaust valve 4 and an intake valve 5 respectively. The engine 1 has also a carburetor 6 in the intake pipe 3. An exhaust gas recirculation valve 7 is mounted on the exhaust pipe 2, putting a detachable gasket member 8 therebetween. The exhaust gas recirculation valve 7 has a chamber 70 divided into two compartments by a diaphragm arrangement 71 one of which compartment is communicated with the intake pipe 3 through a pressure switching valve 9 for receiving a pressure signal from a pressure signal inlet pipe 72. The recirculation valve 7 has also a shaft 73 one end of which is fixed to the diaphragm arrangement 71 and the other end of which is fixed to a valve body 74. The valve body 74 is provided in a valve body housing 75 having an inlet 76 and outlet 77. A bellows member 78 is fixed to segregate the chamber 70 from exhaust gas and to prevent the exhaust gas from escaping outside through an atmosphere pipe 80. The recirculation valve 7 further has a valve seat 79 with a valve opening 711 through which the exhaust gas flows from the inlet 76 to the outlet 77. The detachable gasket member 8 has a flow control orifice 81 at the position corresponding to the aforementioned inlet 76. Since the dimension of this orifice is determined to be smaller than that of the valve opening 711, the recirculation rate of the exhaust gas is controlled by this control orifice 81. The exhaust pipe 2 has also an opening 21 at the position corresponding to the aforementioned flow control orifice 81. The recirculation valve 7 is secured to the exhaust pipe by bolts and nuts (not shown).

The operation of the above embodiment is as follows. When the engine 1 has reached the limited condition in which the exhaust gas recirculation is required to reduce the harmful components in the exhaust gas, such as nitrogen oxides, the pressure switching valve 9 is switched to apply the intake manifold pressure to the diaphragm arrangement 71 through the inlet pipe 72. Therefore, the diaphragm arrangement 71 goes upwardly to lift the shaft 73 and valve body 74, thereby causing the exhaust gas to flow from exhaust pipe 2, through opening 21, flow control orifice 81, inlet 76, valve opening 711 and outlet 77 to upstream of the throttle valve 31 provided in the intake pipe 3. The exhaust gas in the intake mixture suppresses the generation of nitrogen oxides in the engine 1. On the other hand, when the pressure switching valve 9 is switched off, no pressure signal from the intake manifold is applied to the diaphragm arrangement 71, and instead the atmospheric pressure is applied to the diaphragm arrangement 71 through the pressure switching valve 9, resulting in the closure of the valve body 74 by the spring action in the well-known manner.

This exhaust gas recirculation system is applicable to many types of engine requiring various exhaust gas recirculation rates, because the recirculation rate can be easily changed just by exchanging the detachable gasket member 8 to the other one having different control orifice. Further, the control orifice 81 is easily cleaned or renewed before the deposits excessively build up so as to prevent the micontrol of recirculation rate.

What we claim is:

1. An exhaust gas recirculation system for internal combustion engines having an exhaust pipe and an intake pipe comprising:

a pressure control chamber with a diaphragm arrangement for receiving a pressure signal, a shaft fixed to said diaphragm arrangement for reciprocally moving in accordance with said pressure signal, a valve body housing an inlet and outlet, a valve seat disposed in valve body housing between said inlet and outlet, said valve seat having a valve opening, a valve body fixed to said shaft and disposed in said valve housing, said valve body seating on said valve seat for opening and closing said valve opening in accordance with the reciprocal movement of said shaft so that said outlet is connected with said inlet when valve opening is opened, a bellows member fixed between said diaphragm arrangement and said valve body housing, and a detachable gasket member disposed between said valve body housing and said exhaust pipe, and having a flow control orifice at a position corresonding to said inlet, said flow control orifice being smaller than that of the valve opening of said valve seat so that the amount of exhaust gas flowing through said flow control orifice is thereby controlled, said exhaust pipe also having an opening at a position corresponding to said flow control orifice, whereby the exhaust gases of said engine flow from said exhaust pipe into said intake pipe through said opening, flow control orifice, and valve body housing when said diaphragm arrangement receives said pressure signal, while in the reverse condition, the exhaust gas flow is interrupted by said valve body, and said detachable gasket member can be easily cleared or renewed when said recirculation system has run over a limited period and further can be changed in compliance with the type of engine to match the dimension of said flow control orifice to the required exhaust gas flow rate specific to said type of engine.

* * * * *